US010854354B2

(12) United States Patent
Varkey et al.

(10) Patent No.: US 10,854,354 B2
(45) Date of Patent: Dec. 1, 2020

(54) DOWNHOLE CABLES AND METHODS OF MAKING THE SAME

(71) Applicant: Schlumberger Technology Corporation, Sugar Land, TX (US)

(72) Inventors: Joseph Varkey, Sugar Land, TX (US); Sheng Chang, Sugar Land, TX (US); Burcu Unal Altintas, Richmond, TX (US); Qingdi Huang, Sugar Land, TX (US); Jeffrey Joseph Kamps, Katy, TX (US); Paul Wanjau, Missouri City, TX (US)

(73) Assignee: SCHLUMBERGER TECHNOLOGY CORPORATION, Sugar Land, TX (US)

( * ) Notice: Subject to any disclaimer, the term of this patent is extended or adjusted under 35 U.S.C. 154(b) by 454 days.

(21) Appl. No.: 15/655,979

(22) Filed: Jul. 21, 2017

(65) Prior Publication Data

US 2017/0323705 A1 Nov. 9, 2017

Related U.S. Application Data

(63) Continuation of application No. 14/788,535, filed on Jun. 30, 2015, now abandoned.

(51) Int. Cl.

| | |
|---|---|
| ***H01B 7/04*** | (2006.01) |
| ***H01B 13/22*** | (2006.01) |
| *H01B 7/18* | (2006.01) |

(52) U.S. Cl.
CPC ..... *H01B 7/046* (2013.01); *H01B 13/228* (2013.01); *H01B 7/18* (2013.01)

(58) Field of Classification Search
CPC ..... H01B 7/046; H01B 7/18; H01B 13/228; H01B 13/0036; B65H 59/105; B65H 59/12; B65H 59/40; B65H 59/16; B65H 59/18
USPC ..... 29/825, 592.1
See application file for complete search history.

(56) References Cited

U.S. PATENT DOCUMENTS

| | | | | |
|---|---|---|---|---|
| 3,732,680 | A | 5/1973 | Barrier | |
| 3,784,732 | A * | 1/1974 | Whitfill, Jr. | D07B 5/12 174/108 |
| 4,009,561 | A | 3/1977 | Young | |
| 2006/0151194 | A1 | 7/2006 | Varkey et al. | |
| 2006/0242824 | A1* | 11/2006 | Varkey | H01B 13/26 29/825 |
| 2009/0283295 | A1 | 11/2009 | Varkey et al. | |
| 2010/0263904 | A1 | 10/2010 | Varkey et al. | |
| 2015/0371741 | A1* | 12/2015 | Leggett | B65H 54/12 432/3 |

* cited by examiner

*Primary Examiner* — Peter Dungba Vo
*Assistant Examiner* — Azm A Parvez
(74) *Attorney, Agent, or Firm* — Eileen Pape

(57) ABSTRACT

A method and method of using a cable that includes a cable core. The cable core has an inner armor wire layer disposed thereabout. The inner armor wire layer has an outer armor wire layer disposed thereabout. The inner armor wire layer and outer armor wire layer have torque removed therefrom during manufacturing.

15 Claims, 6 Drawing Sheets

DOWNHOLE CABLES AND METHODS OF MAKING THE SAME

RELATED APPLICATIONS

The present document is a continuation of and claims priority to co-pending U.S. application Ser. No. 14/788,535, filed Jun. 30, 2015, entitled "Downhole Cables and Methods of Making the Same" to Joseph Varkey et al., which is incorporated herein by reference in its entirety.

FIELD OF THE DISCLOSURE

The disclosure generally relates to cables and methods of making the same.

BACKGROUND

Cables often develop built-in torque during manufacturing. The built-in torque is often removed at a wellsite as the cable is seasoned. The seasoning of a cable can be time consuming.

SUMMARY

An example cable has a cable core. The cable core has an inner armor wire layer disposed about the cable core. An outer armor wire layer is disposed about the inner armor wire layer. The torque in the armor wire layer is removed during manufacturing.

An example method of running a tool into a wellbore includes connecting a downhole tool with a cable. The cable is manufactured by disposing an inner armor wire layer about a cable core. The method also includes locking the inner armor wire layer in place using a polymer located about the cable core. The method also includes disposing an outer armor wire layer about the inner armor wire layer, forming the cable. The method also includes stretching the cable, and reducing the tension in the cable. The method also includes removing torque from the cable.

An example method of manufacturing a cable includes cabling an inner armor wire layer about a cable core and locking the inner armor wire layer in place. The method also includes cabling an outer armor wire layer about the inner armor wire layer, forming a cable. The cable is stretched and residual torque is removed from the cable.

DETAILED DESCRIPTION

Figure 1:
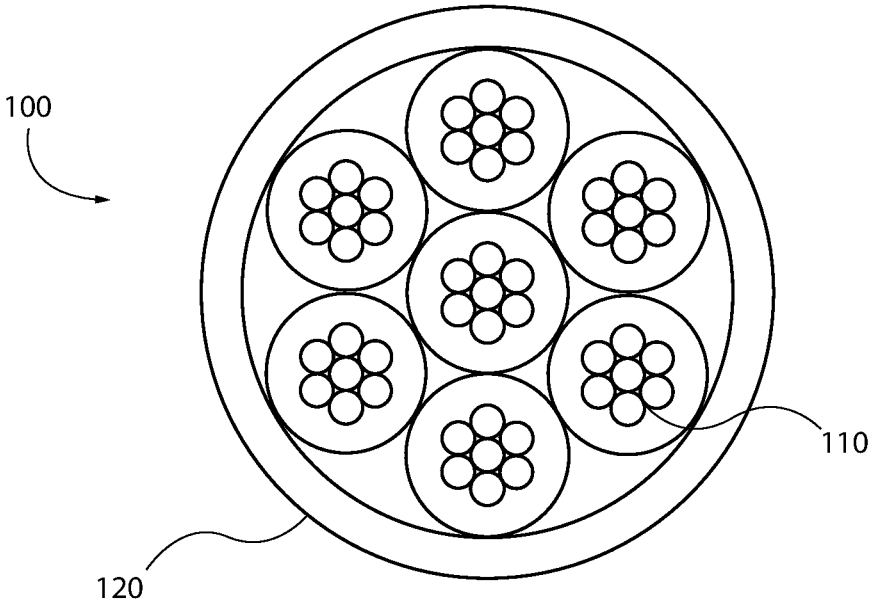
FIG. 1 depicts an example cable core.

Certain examples are shown in the above-identified figures and described in detail below. In describing these examples, like or identical reference numbers are used to identify common or similar elements. The figures are not necessarily to scale and certain features and certain views of the figures may be shown exaggerated in scale or in schematic for clarity and/or conciseness.

An example cable includes a cable core. The cable core can have one or more conductors. For example, the cable core can have one conductor, four conductors, seven conductors, or any other number of conductors. The conductors can be metallic conductors, half shell conductors containing an optical fiber located between the half shell conductors, an optical fiber in a tube, stranded metallic conductors, the like, or combinations thereof.

The example cable can have an inner armor wire layer disposed about the cable core. The inner armor wire layer can include one or more strength members. The strength members can be composite strength members, metallic strength members, the like, or combinations thereof.

The cable core can have a polymer layer disposed thereabout. The polymer layer can be carbon reinforced polymer, Polyether ether ketone, Polyaryletherketone, fluoropolymer, other now know or future know polymer, virgin polymer, or combinations thereof. The inner armor wire layer can be locked in place by embedding into the polymer layer. For example, a polymer layer can be extruded about the cable core, the polymer layer can be heated before cabling the inner armor wire layer about the cable core, while cabling the inner armor wire layer about the cable core, or combinations thereof, the heated polymer layer can be made soft by the heating and the inner armor wire layer can embed into the polymer layer. The heating can be accomplished using inferred heating, radiant heating, or other types of heating that is now known or future known. The inner armor wire layer can be helically cabled about the cable core.

The cable can also include an outer armor wire layer disposed about the inner armor wire layer. The outer armor wire layer can be counter helically cabled about the inner armor wire layer. The torque in the armor wire layers can be removed during manufacturing.

In one or more embodiments of the cable, an additional polymer layer can be extruded over the inner armor wire layer before the outer armor wire layer is cabled about the inner armor wire layer. The additional polymer layer can be carbon reinforced polymer, Polyether ether ketone, Polyaryletherketone, fluoropolymer, other now know or future know polymer, virgin polymer, or combinations thereof.

The outer armor wire layer can be embedded into the additional polymer layer. For example, the additional polymer layer can be heated before cabling the outer armor wire layer about the inner armor wire layer, heated while cabling the outer armor wire layer about the inner armor wire layer, or combinations thereof, and the heating can make the additional polymer layer soft, allowing the outer armor wire layer to embed into the additional polymer layer. In one or more embodiments, the additional polymer layer can bond with the polymer layer. In one or more embodiments, an outer jacket can be placed about the outer polymer layer. The outer jacket can be made from a polymer or other suitable material.

An example method of manufacturing a seasoned cable can include cabling an inner armor wire layer about a cable core, and locking the inner armor wire layer in place. The method can also include cabling an outer armor wire layer about the inner armor wire layer, forming a cable. The method further includes stretching the cable; and removing residual torque from the stretched cable.

The method can also include heating a polymer layer while cabling the inner armor wire layer about the polymer layer, before cabling the inner armor wire layer about the polymer layer, or combinations thereof. The heated polymer layer is made soft, allowing the inner armor wire layer to embed into the polymer layer; thereby, locking the inner armor wire layer in place.

In one or more embodiments of the method, an additional polymer layer can be placed about the inner armor wire layer before cabling the outer armor wire layer about the inner armor wire layer.

In one or more embodiments, the additional polymer layer can be heated while cabling the outer armor wire layer about the inner armor wire layer, before cabling the outer armor wire layer about the inner armor wire layer, or combinations thereof.

In one or more embodiments of the method, stretching the cable can include passing the cable from an initial drum through a first capstan and a second capstan. Tension can be applied to the cable by the capstans, and the tension can be reduced as the cable exits the second capstan. The stretched cable can be spooled onto a drum. A turn around sheave can be located between the capstans to direct the cable between the capstans.

In one or more embodiments, removing residual torque from the stretched cable can include spooling the cable from the second drum to a swivel sheave, wherein the second drum is configured to rotate as the cable is spooled therefrom to remove torque from the cable. The rotation of the second drum can be adjusted depending on the direction and magnitude of rotation of the swivel sheave. The method can also include passing the cable from the swivel sheave to an intermediate sheave. In torque balanced conditions the swivel sheave will be aligned with the intermediate sheave. The method can also include passing the cable from the intermediate sheave to a third capstan. The method can also include passing the cable from the third capstan to a second turn around sheave, and passing the cable to a third drum.

An example method of running a tool into a wellbore can include connecting a cable made according to one or more methods described herein to a downhole tool. The downhole tool can be a tractor, logging tool, shifting tool, intervention tool, or combinations thereof.

FIG. 1 depicts an example cable core. The example cable core 100 includes one or more conductors 110 and a polymer layer 120. The conductors 110 can be any now known or future known conductor. The cable core 100 can include any number of conductors 110.

Figure 2:
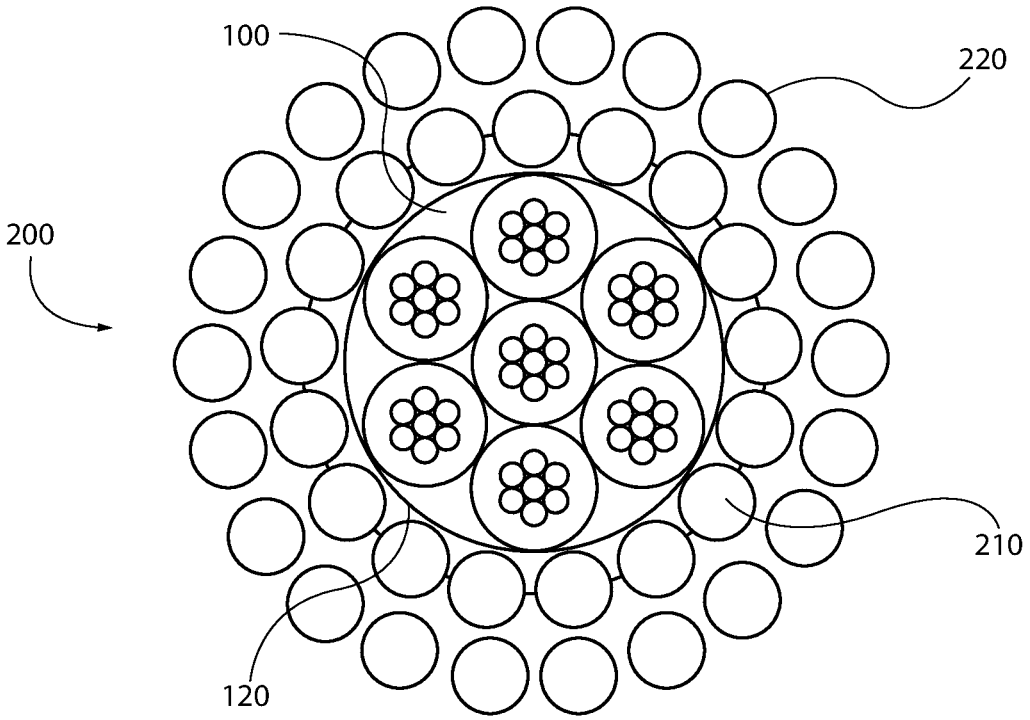
FIG. 2 depicts an example cable.

FIG. 2 depicts an example cable. The example cable 200 includes the cable core 100, an inner armor wire layer 210, and an outer armor wire layer 220. The inner armor wire layer 210 can be cabled about the polymer layer 120. The polymer layer 120 can be heated prior to cabling the inner armor wire layer 210 thereabout. In another embodiment, the polymer layer 120 can be heated while the inner armor wire layer 210 is cabled about the polymer layer 120. The heated polymer layer 120 can become soft, due to the heating, allowing the inner armor wire layer 210 to at least partially embed therein.

The outer armor wire layer 220 can be cabled about the inner armor wire layer 210. The inner armor wire layer 210 can be helically cabled about the polymer layer, and the outer armor wire layer 220 can be counter helically cabled about the inner armor wire layer 220.

Figure 3:
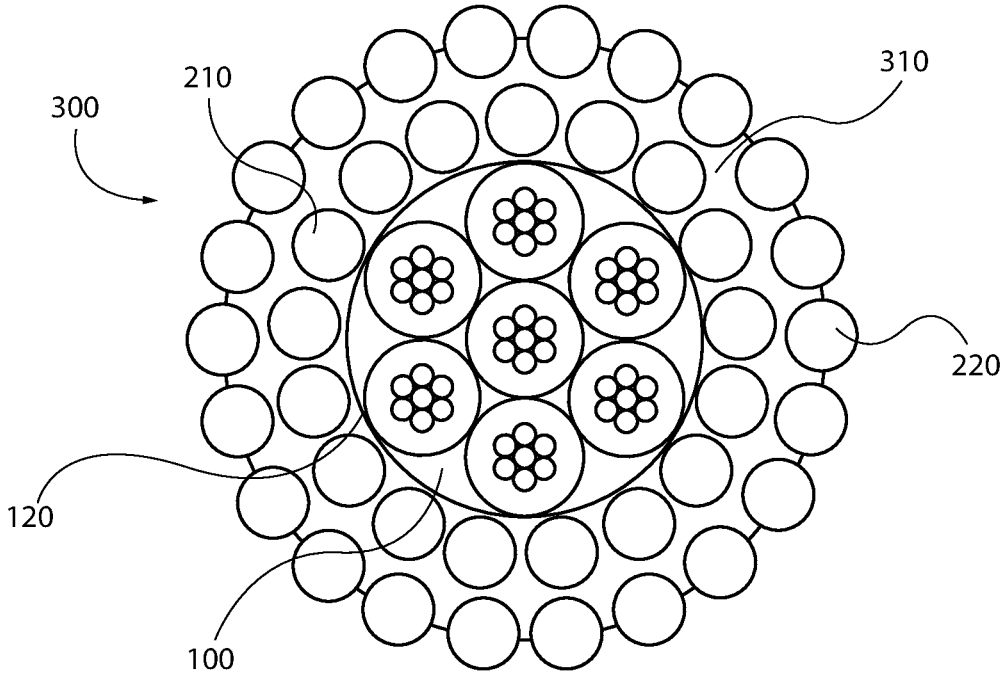
FIG. 3 depicts another example cable.

FIG. 3 depicts another example cable. The example cable 300 includes the cable core 100, the inner armor wire layer 210, the outer armor wire layer 220, and an additional polymer layer 310.

The inner armor wire layer 210 can be embedded into the polymer layer 120. The additional polymer layer 310 can be placed about the inner armor wire layer 210. The additional polymer layer 310 can be heated while cabling the outer armor wire layer 220 about the additional polymer layer 310, before cabling the outer armor wire layer 220, or combinations thereof. The heating of the additional polymer layer 310 can become soft due to the heating, allowing the outer armor wire layer 220 to at least partially embed into the additional polymer layer 310.

Figure 4:
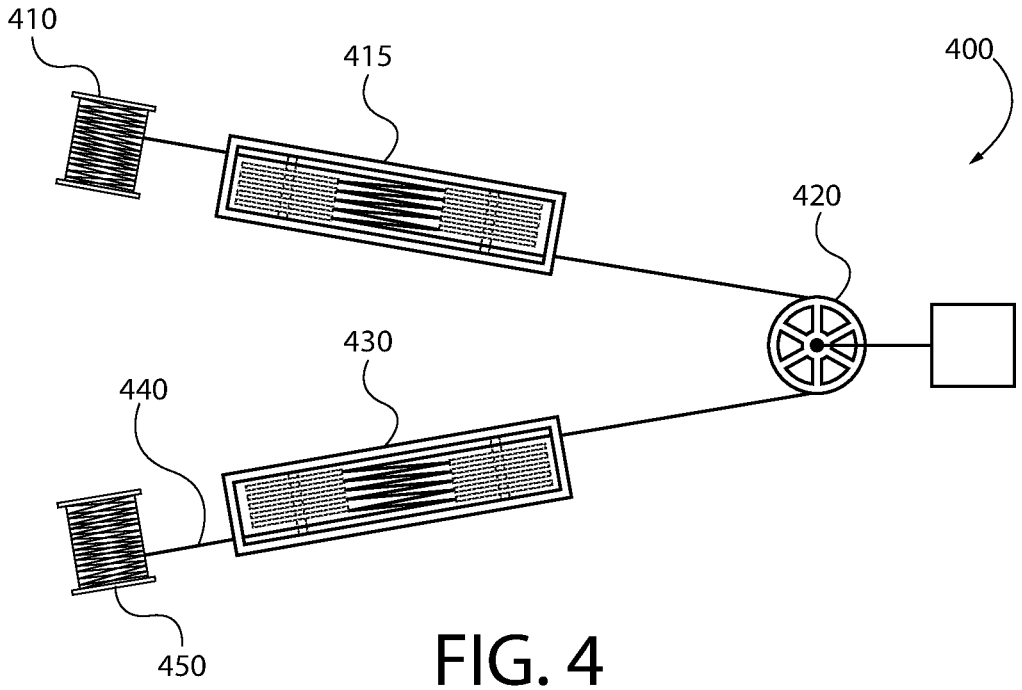
FIG. 4 depicts an example system for stretching a cable.

FIG. 4 depicts an example system for stretching a cable. The system 400 can include an unseasoned cable pay-out drum 410, a first capstan 415, a turn-around sheave 420, a second capstan 430, and a stretched cable drum 450.

The cable, which can be any of those disclosed herein or a substantially similar cable, can pass from the unseasoned cable pay-out drum 410 to the first capstan 415. The cable can pass from the first capstan 415 to the turn-around sheave 420. The turn-around sheave 420 direct the cable to the second capstan. The capstans cooperate to apply tension to the cable; thereby, stretching the cable and tightening the armor wire layers about the cable core. The capstans can tension the cable up to its safe working load.

The cable can then pass to the second capstan 430. The second capstan 430 can reduce tension in the stretched cable, and the stretched cable 440 can be spooled on the stretched cable drum 450.

Figure 5:
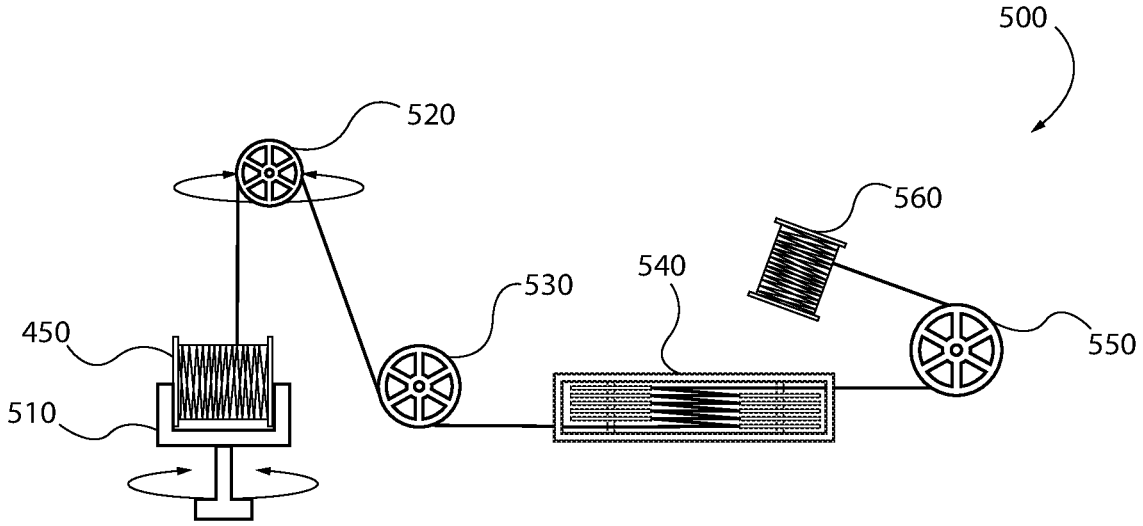
FIG. 5 depicts an example system for removing torque from a cable.

FIG. 5 depicts an example system for removing torque from a cable. The system 500 can includes the stretched cable drum 450, a twister 510, a swivel sheave 520, an intermediate sheave 530, a third capstan 540, an additional turn-around sheave 550, and a seasoned cable drum 560.

The stretched cable drum 450 can be placed on the twister 510. The twister 510 can rotate, removing excess torque from the stretched cable. The rotation of the twister 510 can be adjusted according to the magnitude and direction of rotation of the swivel sheave 520. For example, the twister can be driven by a motor and the motor can be in communication with a control panel. An operator or processor can control the speed and rotation of the twister using the control panel.

The stretched cable can pass from the stretched cable drum 450 to the swivel sheave 520; the stretched cable passes from the swivel sheave 520 to the intermediate sheave 530. In torque balanced conditions the swivel sheave 520 will align with the intermediate sheave 530. An example of operation, the cable can be passed to the swivel sheave 520, if torque is built into the cable the swivel sheave will not align with the intermediate sheave 530, the twister can be rotated until the swivel sheave 520 aligns with the intermediate sheave 530, then more cable can be paid out to move to a new section of the cable, and the operation can be repeated. In another embodiment, the cable can continue to be paid out and the operator can adjust the twister actively to remove torque, the operator can also coordinate the cable running speed and twister rotation to make sure all torque built into the cable is release. The rotation of the twister and speed of cable can also be adjusted depending on differing torque in sections of the cable.

From the intermediate sheave 530 the stretched cable passes to the third capstan 540. The third capstan 540 increases tension in the stretched cable. The stretched cable then passes to the additional turn around sheave 550. From the additional turn-around sheave 550 the cable is spooled onto the seasoned cable drum 560.

Figure 6:
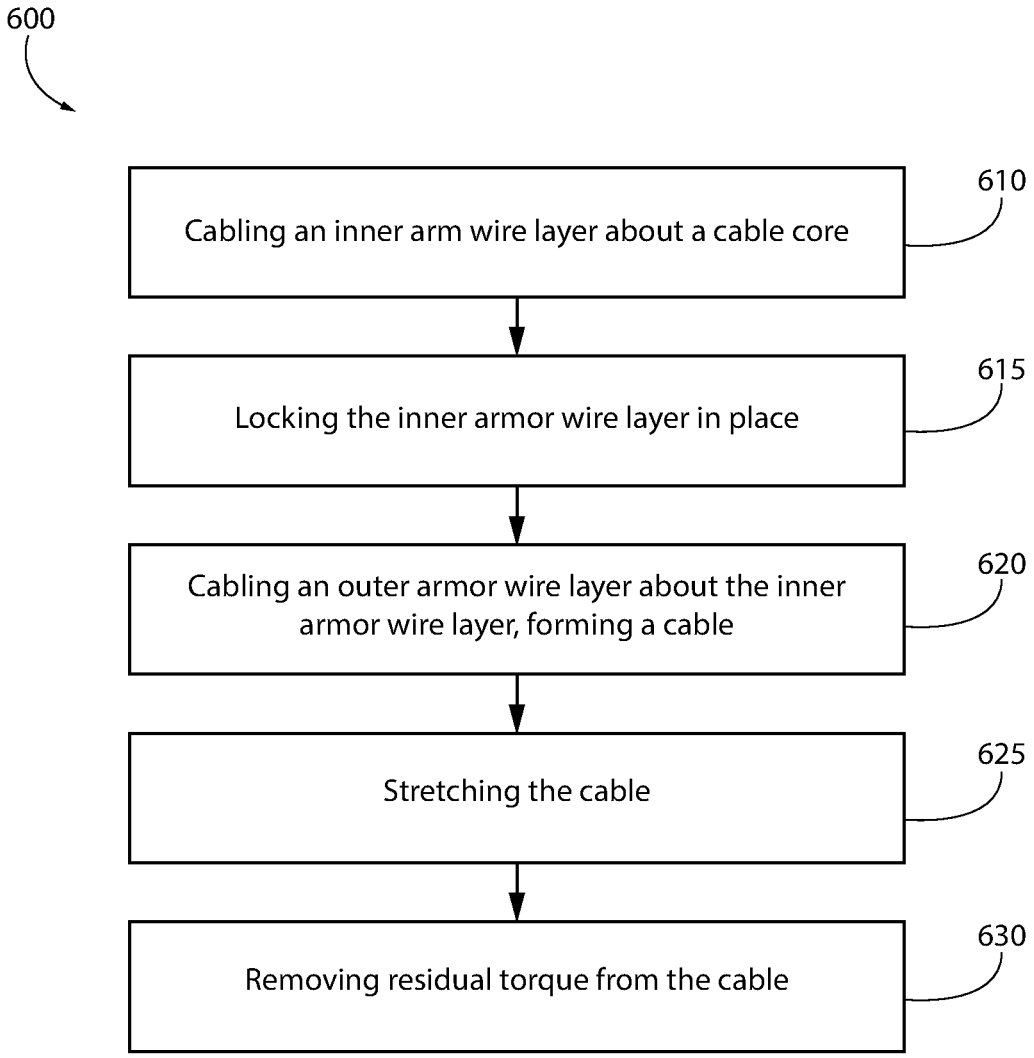
FIG. 6 depicts an example method of manufacturing a cable.

FIG. 6 depicts an example method of manufacturing a cable. The method 600 includes cabling an inner armor wire layer about a cable core, Box 610. The method also includes locking the inner armor wire layer in place, Box 615. The method also includes cabling an outer armor wire layer about the inner armor wire layer, forming a cable, Box 620. The method also includes stretching the cable, Box 625. The method also includes removing residual torque from the cable, Box 630.

Figure 7:
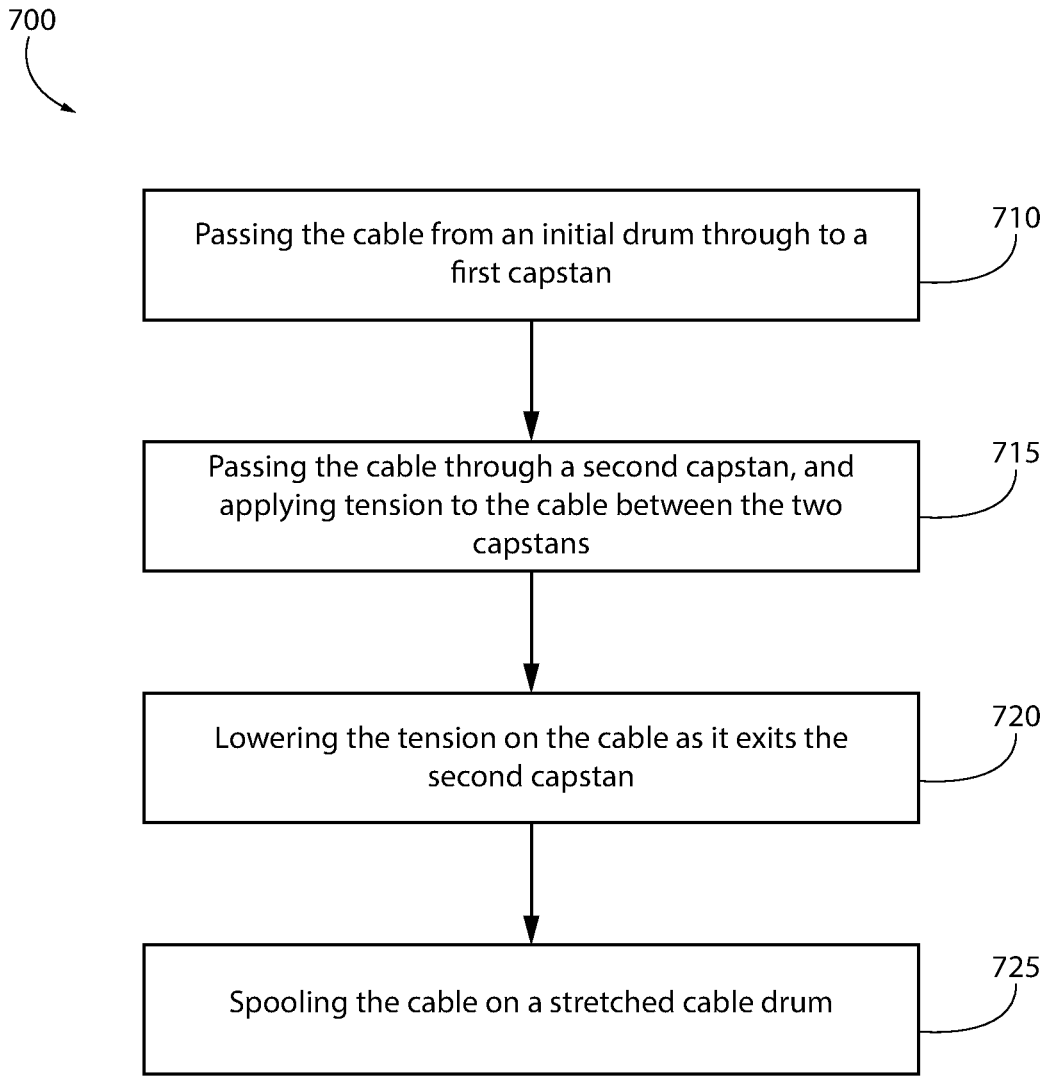
FIG. 7 depicts an example method of stretching a cable.

FIG. 7 depicts an example method of stretching a cable. The method 700 includes passing the cable from an initial drum through to a first capstan, Box 710. The method also includes passing the cable through a second capstan, and applying tension to the cable between the two capstans, Box 715. The tension on the cable is generated by the capstans. The method also includes lowering the tension on the cable as it exits the second capstan, Box 720. The method also includes spooling the cable on a stretched cable drum, Box 725.

Figure 8:
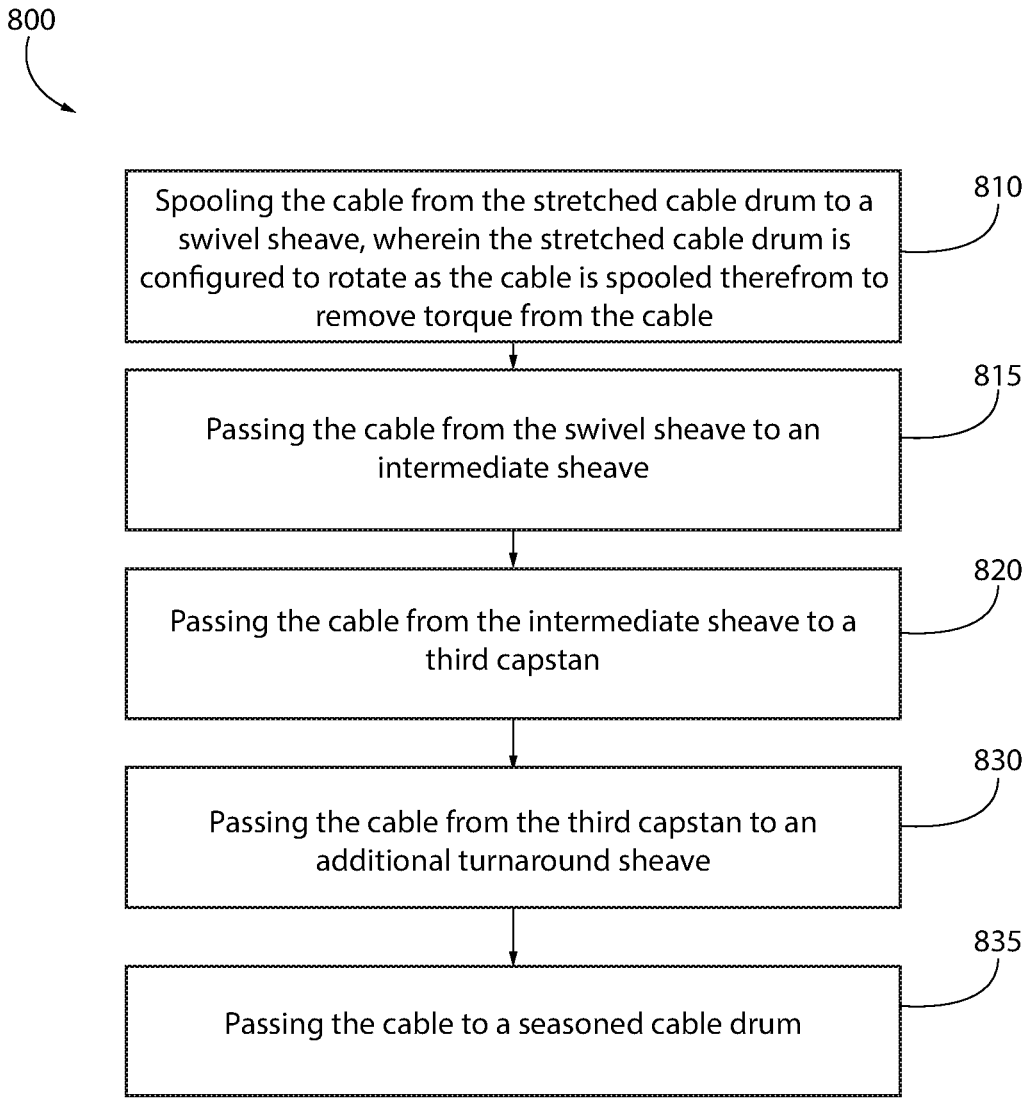
FIG. 8 depicts an example method of removing torque from a cable.

FIG. 8 depicts an example method of removing torque from a cable. The method 800 includes spooling the cable from the stretched cable drum to a swivel sheave, wherein the second drum is configured to rotate as the cable is spooled therefrom to remove torque from the cable, Box 810. The method also include passing the cable from the swivel sheave to an intermediate sheave, Box 815. The method also include passing the cable from the intermediate sheave to a third capstan, Box 820. The method also includes passing the cable from the third capstan to an additional turnaround sheave, Box 830. The method also includes passing the cable to a seasoned cable drum, Box 835.

Although example assemblies, methods, systems have been described herein, the scope of coverage of this patent is not limited thereto. On the contrary, this patent covers every method, apparatus, and article of manufacture fairly falling within the scope of the appended claims either literally or under the doctrine of equivalents.

What is claimed is:

1. A method of manufacturing a cable, wherein the method comprises:

disposing an inner armor wire layer about a cable core;

disposing an outer armor wire layer about the inner armor wire layer, forming the cable, wherein the cable is stretched and then has tension therein reduced as the cable is spooled onto a stretched cable drum, and wherein torque in the armor wire layers is removed during manufacturing by placing the stretched cable drum on a twister, and wherein (a) the stretched cable passes from the stretched cable drum to a swivel sheave, from the swivel sheave to an intermediate sheave, and (b) the twister twists the cable until the swivel sheave aligns with the intermediate sheave, and then additional cable is spooled from the stretched cable drum, and wherein the foregoing (a) and (b) are repeated until any residual torque is removed from the cable.

2. The method of claim 1, further comprising embedding the inner armor wire layer in a polymer.

3. The method of claim 2, wherein the polymer is a carbon reinforced polymer.

4. The method of claim 2, further comprising helically cabling the inner armor wire layer about the cable core.

5. The method of claim 4, further comprising counter helically cabling the outer armor wire layer about the inner armor wire layer.

6. The method of claim 5, further comprising extruding an additional polymer layer over the inner armor wire layer before cabling of the outer armor wire layer about the inner armor wire layer.

7. The method of claim 6, further comprising heating the additional polymer layer to allow the outer armor wire layer to at least partially embed into the second polymer layer.

8. A method of running a tool into a wellbore, wherein the method comprises:

connecting a downhole tool with a cable, wherein the cable is manufactured by:

disposing an inner armor wire layer about a cable core;

locking the inner armor wire layer in place using a polymer located about the cable core;

disposing an outer armor wire layer about the inner armor wire layer, forming the cable;

stretching the cable;

passing the cable from an initial drum through a first capstan;

passing the cable through a second capstan, wherein tension is applied to the cable by the two capstans, and tension is reduced as the cable exits the second capstan;

spooling the cable on a stretched cable drum;

reducing tension in the cable;

removing torque from the cable;

spooling the cable from the stretched cable drum to a swivel sheave, wherein the stretched cable drum is configured to rotate as the cable is spooled therefrom to remove torque from the cable;

passing the cable from the swivel sheave to an intermediate sheave;

passing the cable from the intermediate sheave to a third capstan;

passing the cable from the third capstan to an additional turn around sheave; and passing the cable to a seasoned cable drum.

9. The method of claim 8, wherein the downhole tool is a tractor, logging tool, shifting tool, intervention tool, or combinations thereof.

10. The method of claim 8, wherein the polymer is a carbon reinforced polymer.

11. A method of manufacturing a cable, wherein the method comprises:

cabling an inner armor wire layer about a cable core;

locking the inner armor wire layer in place;

cabling an outer armor wire layer about the inner armor wire layer, forming a cable;

stretching the cable;

passing the cable from an initial drum through a first capstan;

passing the cable through a second capstan, wherein tension is applied to the cable by the two capstans, and tension is reduced as the cable exits the second capstan;

spooling the cable on a stretched cable drum;

removing residual torque from the cable;

spooling the cable from the stretched cable drum to a swivel sheave, wherein the stretched cable drum is configured to rotate as the cable is spooled therefrom to remove torque from the cable;

passing the cable from the swivel sheave to an intermediate sheave;

passing the cable from the intermediate sheave to a third capstan;

passing the cable from the third capstan to an additional turn around sheave; and passing the cable to a seasoned cable drum.

12. The method of claim 11, further comprising heating a polymer layer while cabling the inner armor wire layer about the polymer layer, before cabling the inner armor wire layer about the polymer layer, or combinations thereof.

13. The method of claim 12, wherein locking the inner armor wire layer in place comprises embedding the inner armor wire layer in the polymer layer.

14. The method of claim 12, further comprising placing an additional polymer layer about the inner armor wire layer before cabling the outer armor wire layer about the inner armor wire layer.

15. The method of claim 14, further comprising heating the additional polymer layer while cabling the outer armor wire layer about the inner armor wire layer, before cabling the outer armor wire layer about the inner armor wire layer, or combinations thereof.

* * * * *